US011415340B2

(12) United States Patent
Zhang et al.

(10) Patent No.: US 11,415,340 B2
(45) Date of Patent: Aug. 16, 2022

(54) WATER HEATING SYSTEM WITH INCLINED HEATING ELEMENT

(71) Applicant: Rheem Manufacturing Company, Atlanta, GA (US)

(72) Inventors: Qian Zhang, Montgomery, AL (US); Atilhan Manay, Montgomery, AL (US); Saman Beyhaghi, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/101,527

(22) Filed: Nov. 23, 2020

(65) Prior Publication Data

US 2022/0163234 A1 May 26, 2022

(51) Int. Cl.

| | |
|---|---|
| ***F24H 1/18*** | (2022.01) |
| ***F24D 19/10*** | (2006.01) |
| ***F24H 1/20*** | (2022.01) |

(52) U.S. Cl.

CPC ..... *F24H 1/181* (2013.01); *F24D 19/1051* (2013.01); *F24H 1/185* (2013.01); *F24H 1/202* (2013.01)

(58) Field of Classification Search

CPC ..... F24H 1/202; F24H 1/185; F24H 9/1818; F24H 9/2021; F24H 1/181; H05B 3/02; H05B 3/03; F24D 19/1051

USPC ..... 392/441, 442, 443, 451, 454, 473, 446

See application file for complete search history.

(56) References Cited

U.S. PATENT DOCUMENTS

| | | | | | |
|---|---|---|---|---|---|
| 2,307,061 | A * | 1/1943 | Morrow | F24H 9/1818 | 392/464 |
| 2,375,871 | A * | 5/1945 | Reifenberg | F24H 1/202 | 392/452 |
| 2,544,458 | A * | 3/1951 | Higgins | H05B 3/06 | 392/455 |
| 2,650,287 | A * | 8/1953 | Adams | H05B 3/06 | 392/453 |
| 5,371,831 | A * | 12/1994 | Gauer | F24H 9/1818 | 220/319 |
| 2017/0051946 | A1* | 2/2017 | Nolte | F24H 1/185 | |

(Continued)

FOREIGN PATENT DOCUMENTS

| | | | | |
|---|---|---|---|---|
| AT | 376864 B | * | 1/1985 | F24H 1/202 |
| CH | 294613 A | * | 11/1953 | F24H 9/1818 |

(Continued)

OTHER PUBLICATIONS

International Search Report and Written Opinion for PCT Application No. PCT/US2021/060278 dated Mar. 3, 2022.

*Primary Examiner* — Edelmira Bosques
*Assistant Examiner* — Brett Peterson Mallon
(74) *Attorney, Agent, or Firm* — Eversheds Sutherland (US) LLP

(57) ABSTRACT

A water heating system is provided. The water heating system includes a tank having a wall, a water inlet defined through the wall and configured to allow ingress of water into the tank, and a water outlet defined through the wall and configured to allow egress of water from the tank. The water heating system also includes a heating element disposed within the tank, having a substantially elongate shape, and being moveable between a first inclination angle with respect to a base of the tank and a second inclination angle with respect to the base of the tank.

16 Claims, 7 Drawing Sheets

(56) References Cited

U.S. PATENT DOCUMENTS

| | | | | |
|---|---|---|---|---|
| 2017/0059208 | A1* | 3/2017 | Chaudhry | H05B 1/0244 |
| 2018/0017270 | A1* | 1/2018 | Armstrong | F24D 17/0068 |
| 2018/0100671 | A1* | 4/2018 | Snider | F24F 13/30 |

FOREIGN PATENT DOCUMENTS

| | | | | | |
|---|---|---|---|---|---|
| CN | 203132114 | U | | 8/2013 | |
| CN | 208332658 | U | | 4/2019 | |
| FR | 2281544 | A1 | * | 3/1976 | F24H 9/1818 |
| GB | 529662 | A | * | 11/1940 | F24H 1/202 |
| KR | 100655145 | B1 | * | 12/2006 | |
| KR | 100949609 | B1 | | 3/2010 | |
| RU | 2689657 | C1 | | 5/2019 | |
| SU | 461482 | A1 | | 5/2019 | |
| WO | WO-2013179285 | A1 | * | 12/2013 | F24H 9/2021 |

* cited by examiner

Horizontal configuration of the first heating element

Inclined configuration of the first heating element

WATER HEATING SYSTEM WITH INCLINED HEATING ELEMENT

TECHNICAL FIELD

The present disclosure relates, in general, to a water heater and, more specifically relates, to a water heating element of the water heater.

BACKGROUND

Water heaters are used to heat and store a quantity of water in a tank thereof for subsequent on-demand delivery for residential and commercial use. Water heaters typically utilize one or more electric resistance heating elements to transfer heat to the water contained in the tank under control of thermostat device that monitors temperature of the water in the tank.

Generally, it is beneficial to maintain a uniform temperature of water within the tank. However, the temperature of the water tends to be cooler at a bottom of the tank and rises as the level of water approaches a top of the tank. In other words, as a result of thermal currents within the tank, thermal energy is driven towards the top of the tank. Such thermal currents may impact the energy efficiency of the water heater and may reduce a first-hour rating of the water heater, which is a measure of a volume of hot water the water heater can supply in the first hour of operation. The first-hour rating is an industry-wide indicator used to establish thermal efficiency of the water heater and hence water heater manufacturers continually strive to increase the first-hour rating.

SUMMARY

According to one aspect of the present disclosure, a water heating system is disclosed. The water heating system includes a tank having a wall. The water heating system further includes a water inlet and a water outlet, both defined through the wall, and respectively configured to allow ingress of water into the tank and egress of water from the tank. The water heating system also includes a first heating element disposed in a first portion of the tank. The first heating element has a substantially elongate shape and is inclined at a first predefined angle with respect to a base of the tank. In an embodiment, the first predefined angle is in a range of about 15 degrees to about 45 degrees. In another embodiment, the first predefined angle is in a range of about 25 degrees to about 35 degrees. In yet another embodiment, the first predefined angle is approximately 30 degrees.

The water heating system further includes a first coupling disposed through the wall of the tank and configured to removably receive the first heating element. In an embodiment, the first coupling defines an aperture, where an axis of the aperture is inclined at the first predefined angle with respect to the base of the tank. The water heating system further includes a first thermostat configured to sense temperature of the water in the first portion of the tank. In an embodiment, the water heating system includes a second heating element disposed in a second portion of the tank, where the second portion is defined proximate the base of the tank. The second heating element is inclined at a second predefined angle with respect to the base of the tank. In an embodiment, the second predefined angle is in a range of zero degree to about 45 degrees. The water heating element further includes a second coupling disposed through the wall of the tank and configured to removably receive the second heating element. Additionally, the water heating system includes a second thermostat configured to sense temperature of the water in the second portion of the tank. In an embodiment, the water heating system also includes an actuator coupled to the first heating element. The actuator is configured to adjust an inclination of the first heating element with respect to the base of the tank based on a user input.

According to another aspect of the present disclosure, a water heating system is disclosed. The water heating system includes a tank having a wall. The water heating system further includes a water inlet and a water outlet, both defined through the wall, and respectively configured to allow ingress of water into the tank and egress of water from the tank. The water heating system also includes a first heating element disposed in a first portion of the tank and configured to heat the water present at least in the first portion of the tank. The first heating element has a substantially elongate shape and is inclined at a first predefined angle with respect to a base of the tank. The water heating system also includes a second heating element disposed in a second portion of the tank defined proximate the base of the tank and configured to heat the water present at least in the second portion of the tank. The second heating element is inclined at a second predefined angle with respect to the base of the tank. In an embodiment, the first predefined angle is in a range of about 15 degrees to about 45 degrees and the second predefined angle is in a range of zero degree to about 45 degrees.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
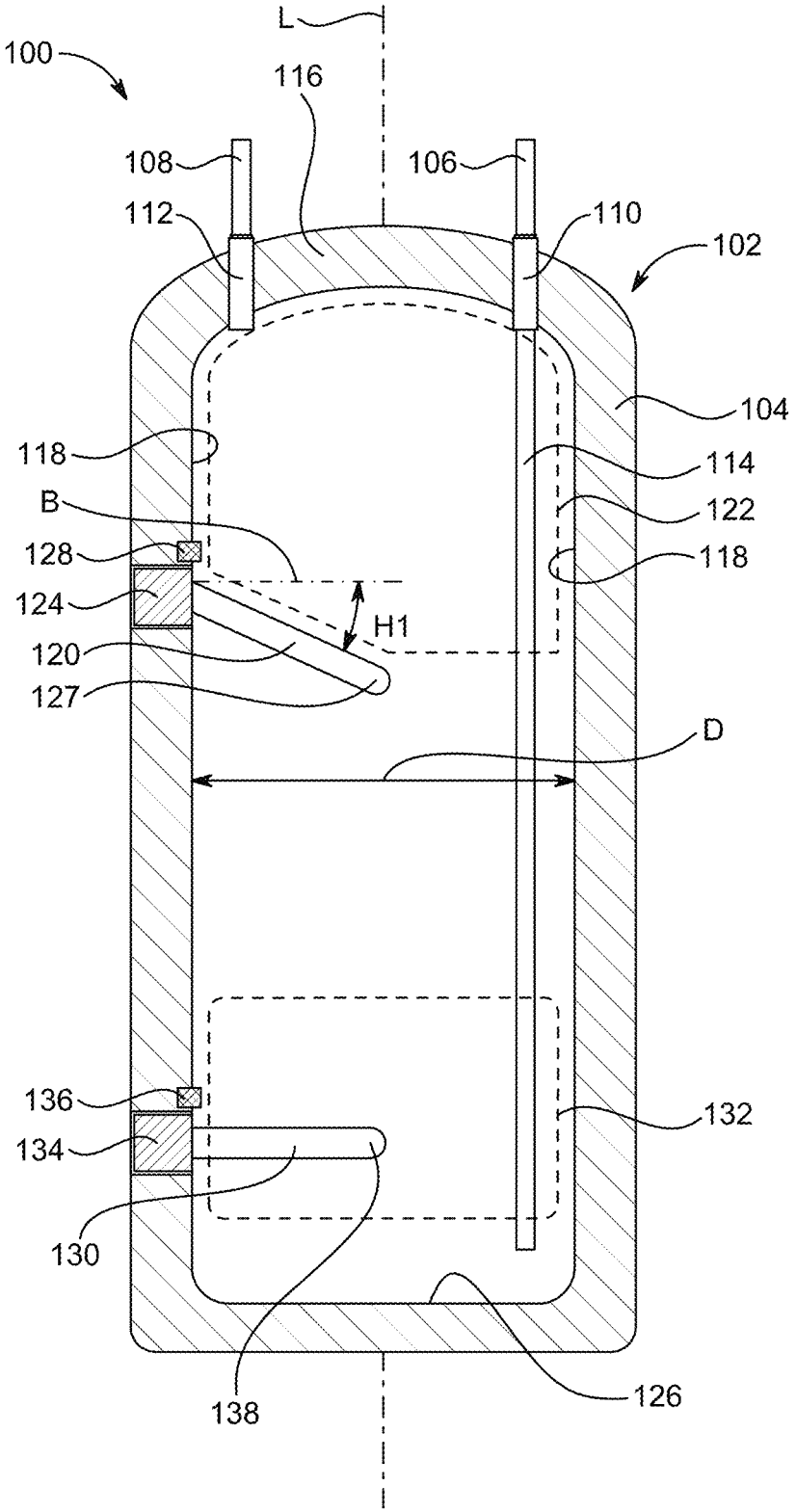
FIG. 1 is a cross-sectional view of a water heating system, according to an embodiment of the present disclosure.

Referring to FIG. 1, a cross-section of a water heating system 100 is illustrated. The water heating system 100 (hereinafter referred to as 'the system 100') includes a tank 102 having a wall 104. In an example, capacity of the system 100 may be, but is not limited to, 50 gallons. The system 100 also includes a water inlet 106 and a water outlet 108 defined through the wall 104. An inlet fitting 110 and an outlet fitting 112 are provided in the wall 104, at a top end 116 of the tank 102, to respectively support the water inlet 106 and the water outlet 108 routed through the wall 104. The water inlet 106 is configured to allow ingress of water into the tank 102 and the water outlet 108 is configured to allow egress of water from the tank 102. A dip tube 114 extends from the inlet fitting 110 along a longitudinal axis 'L' of the tank 102 to supply water to a bottom portion of the tank 102. Heated water is drawn from the tank 102 through the water outlet 108 with aid of, for example, a pump, and may be delivered to one or more end devices, such as laundry washer, dishwasher, faucets, and shower heads. In an embodiment, the wall 104 of the tank 102 may be insulated to retain heat of the water for longer duration. In some embodiments, each of the inlet fitting 110 and the outlet fitting 112 may include a non-return valve to prevent back flow of water to and from the tank 102, respectively.

The system 100 further includes a first heating element 120 disposed in a first portion 122 of the tank 102. As used herein, the phrase 'first portion' may be understood as a portion of the tank 102 extending between an inner surface 118 at the top end 116 and the first heating element 120. Specifically, with the aid of a first coupling 124 of the system 100, the first heating element 120 is disposed inclined at a first predefined angle 'H1' with respect to a base 126 of the tank 102. In an example, the first heating element 120 includes a substantially elongate shape. The term 'substantially elongate' may include a straight portion and a bend portion extending inclined from the straight portion, where a length of bend portion is greater than the straight portion. In one embodiment, the lengths of the straight portion and the bend portion of the first heating element 120 may vary in a range of about 10 percent to about 15 percent. In another embodiment, the lengths of the straight portion and the bend portion of the first heating element 120 may vary in a range of about one percent to about 5 percent. For the purpose of depicting the first predefined angle 'H1', a horizontal line 'B' is illustrated in FIG. 1 that corresponds to a horizontal surface of the base 126. In some embodiments, distance between the top end 116 of the tank 102 and the first coupling 124 may be predefined. As such, volume of the first portion 122 of the tank 102 increases with increase in the distance between the top end 116 of the tank 102 and the first coupling 124. Further, a length of the first heating element 120 may be predetermined based on an inner diameter 'D' of the tank 102, so that a distal end 127 of the first heating element 120 is located distant from a diagonally opposite inner surface 118 of the wall 104. In one embodiment, the first predefined angle 'H1' is in a range of about 15 degrees to about 45 degrees. In another embodiment, the first predefined angle 'H1' is in a range of about 25 degrees to about 35 degrees. In yet another embodiment, the first predefined angle 'H1' is approximately 30 degrees.

The first coupling 124 is disposed through the wall 104 of the tank 102 and is configured to removably receive the first heating element 120. In the illustrated embodiment, the first coupling 124 is integral to the wall 104 of the tank 102. Electric current supply to the first heating element 120 may be routed through the wall 104 and the first coupling 124, as known to a person skilled in the art. The system 100 further includes a first thermostat 128 configured to sense temperature of water in the first portion 122 of the tank 102. Preferably, the first thermostat 128 is located adjacent to the first coupling 124 as shown in FIG. 1.

The system 100 also includes a second heating element 130 disposed in a second portion 132 of the tank 102 defined proximate the base 126 of the tank 102. As used herein, the phrase 'second portion' may be understood to include volume of the bottom portion of the tank 102. Further, the phrases 'first portion' and 'second portion' are used herein for the purpose of clarity in description of aspects relating to heating of the water by the heating elements and should not be considered as limiting.

The second heating element 130 extends parallel to the base 126. Due to constant presence of the water in the second portion 132 of the tank 102, the base 126 may develop scales depending on hardness of the water. Therefore, the second heating element 130 is located at a predetermined height from the base 126 of the tank 102 to prevent being subjected to scaling or prevent any influence of such scaling on operation of the second heating element 130. The system 100 further includes a second coupling 134 disposed through the wall 104 of the tank 102 and configured to removably receive the second heating element 130. Additionally, a second thermostat 136 is located in the second portion 132 and configured to sense temperature of the water in the second portion 132 of the tank 102.

During operation, water is supplied into the tank 102 through the water inlet 106. The supplied water fills the second portion 132 of the tank 102 and gradually fills the entire tank 102. In an embodiment, sensors (not shown) may be located on the inner surface 118 of the tank 102 to sense level of water in the tank 102. Accordingly, based on the water level, each of the second heating element 130 and the first heating element 120 may be operated to heat the water. While the second heating element 130 heats the water in the second portion 132 of the tank 102, the first heating element 120 heats the water present in the first portion 122 of the tank 102 and portions in the vicinity of the first heating element 120. Once the temperature of the water heated in the tank 102, sensed by the first thermostat 128 and the second thermostat 136, reaches a predetermined value, the water is drawn from the tank 102. Since the first heating element 120 is inclined at the first predefined angle 'H1', a large volume of water is under the influence of heat transfer from the first heating element 120 and is hence heated. In the inclined configuration, the first heating element 120 is configured to achieve a first-hour rating (FHR) up to 30 percent greater than an FHR of parallel configuration where the first heating element 120 is disposed parallel to the base 126 of the tank 102.

The components of the system 100 shown in FIG. 1 are not exhaustive. In some embodiments, the system 100 may include additional components to support the operation of the system 100. Conversely, one or more components shown in FIG. 1 may be combined, rearranged, or eliminated.

Figure 2A:
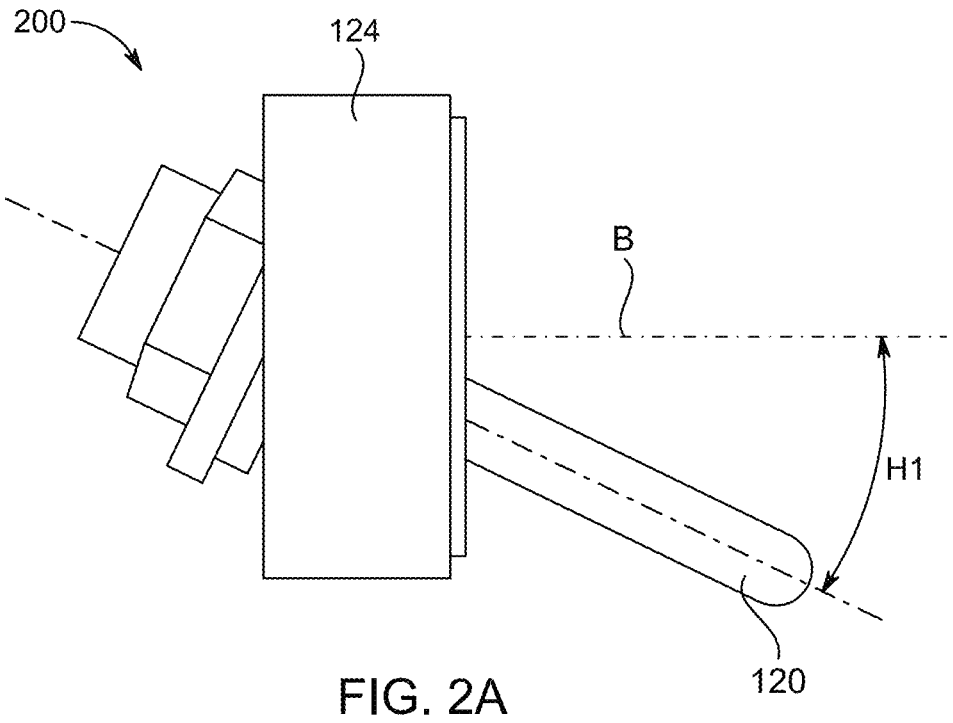
FIG. 2A is a sub-assembly of a first coupling and a first heating element of the water heating system of FIG. 1, according to an embodiment of the present disclosure.
Figure 2B:
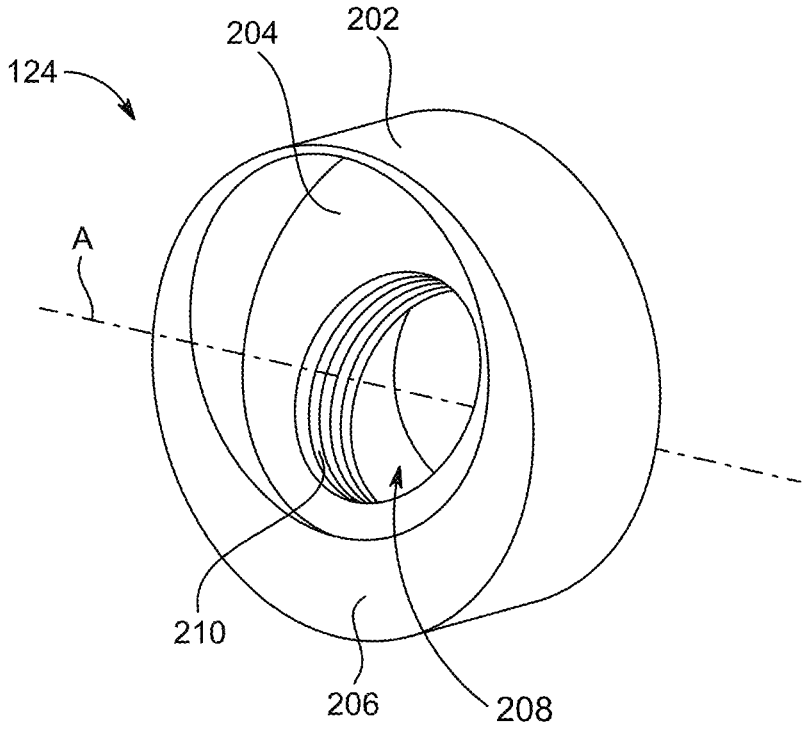
FIG. 2B is a perspective view of the first coupling, according to an embodiment of the present disclosure.
Figure 2C:
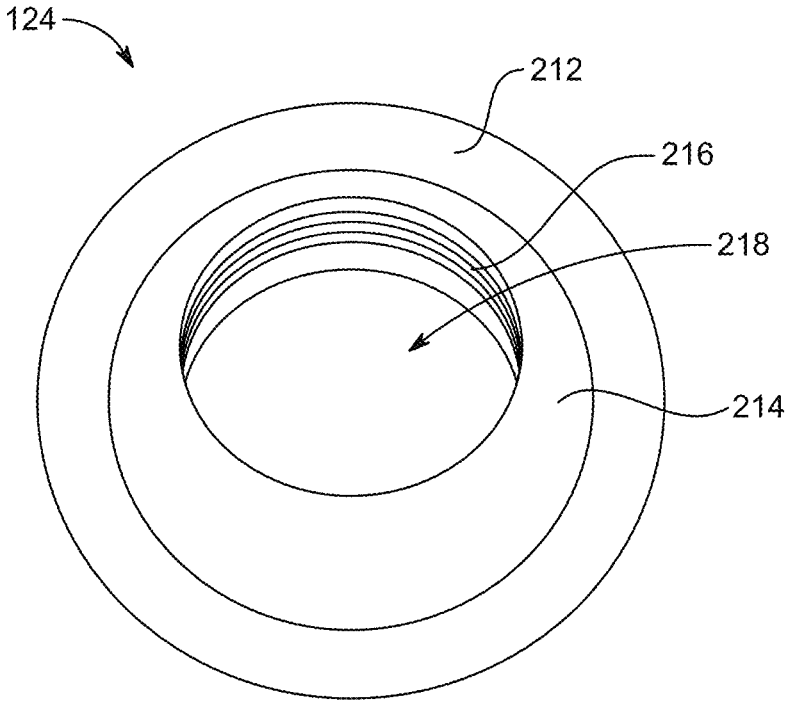
FIG. 2C is a front view of the first coupling, according to another embodiment of the present disclosure.

Referring to FIG. 2A, a sub-assembly 200 of the first coupling 124 and the first heating element 120 is illustrated. FIG. 2B and FIG. 2C illustrates a perspective view and a front view of the first coupling 124, respectively, according to various other embodiments. Referring to FIG. 2B, in an embodiment, the first coupling 124 includes a body portion 202 and an engaging portion 204 surrounded by the body portion 202. The engaging portion 204 lies inclined with respect to a plane containing a peripheral surface 206 of the body portion 202. Further, the engaging portion 204 of the first coupling 124 defines an aperture 208 where an axis 'A' passing through the aperture 202 is inclined at the first predefined angle 'H1' with respect to the horizontal line 'B' (refer FIG. 2A).

Additionally, periphery of the aperture 208 includes threads 210 configured to engage with threads (not shown) of the first heating element 120. In order to achieve the sub-assembly 200, the first heating element 120 is inserted through the aperture 208 and threadably coupled with the first coupling 124. As used herein, the phrase 'threadably coupled' may be understood as a coupling formed between the threads 210 on the periphery of the aperture 208 and the threads (not shown) of the first heating element 120 to form the sub-assembly 200. Such a configuration of the first coupling 124 allows the first heating element 120 to be conveniently and removably disposed into the tank 102 in an inclined manner. Advantageously, requirement of additional components to retain the first heating element 120 at the first predefined angle 'H i' is eliminated.

Referring to FIG. 2C, the first coupling 124, according to another embodiment, includes a body portion 212 and an engaging portion 214 that extends outward from the body portion 212 in an inclined direction, where an angle of inclination is equal to the first predefined angle 'H1'. The engaging portion 214 defines an aperture 218 adapted to removably receive the first heating element 120. A periphery of the aperture 218 includes threads 216 to engage with the threads (not shown) of the first heating element 120. When the first coupling 124 of FIG. 2C is provided in the system 100, the engaging portion 214 may extend from the wall 104 of the tank 102 and hence a user may easily locate the region to insert the first heating element 120. Although FIG. 2A, FIG. 2B and FIG. 2C describes the first coupling 124 defining apertures in an inclined manner with respect to the wall 104 of the tank 102, other ways of achieving the inclined disposition of the first heating element 120 will be apparent to the person skilled in the art. In some embodiments, as described earlier, the first heating element 120 may include the straight portion and the bend portion. The straight portion may be configured to couple with the wall 104 of the tank 102, thereby allowing the bend portion to be disposed in an inclined manner in the tank 102. As such, the straight portion of the heating element may be directly coupled to the wall 104 of the tank 102 in absence of the inclined apertures in the first coupling 124.

Figure 3:
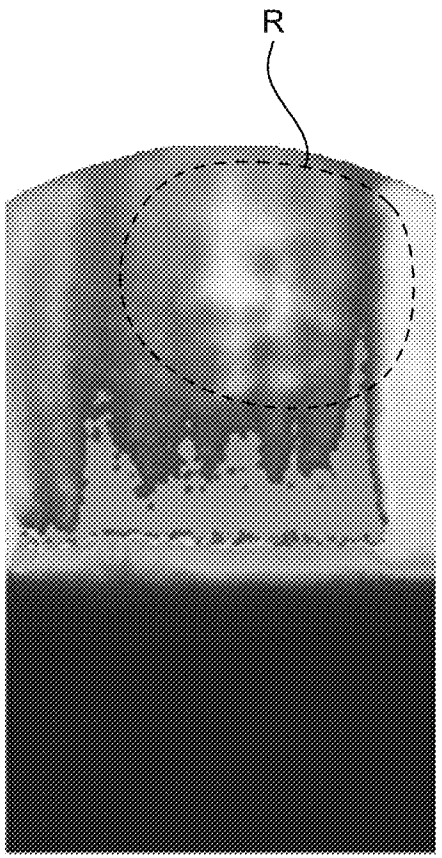
FIG. 3 shows temperature distribution contours for an inclined configuration of the first heating element and a horizontal configuration of the first heating element.
Figure 3:
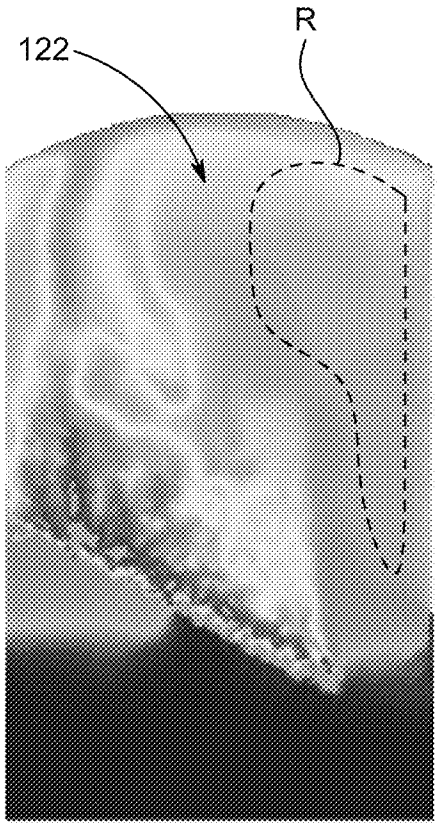
Figure 3:
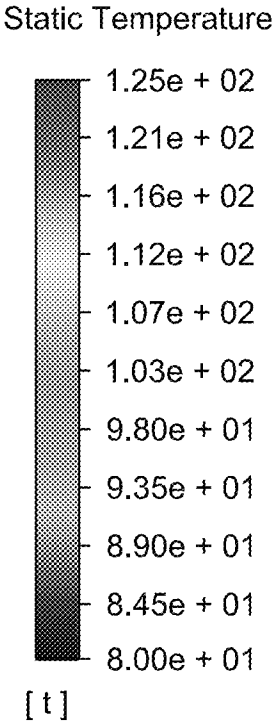

FIG. 3 illustrates temperature distribution contours of heated water in the first portion of the tank 102 for the inclined configuration of the first heating element 120 and the horizontal configuration of the first heating element 120. FIG. 3 is described in conjunction with FIG. 1.

Figure 4:
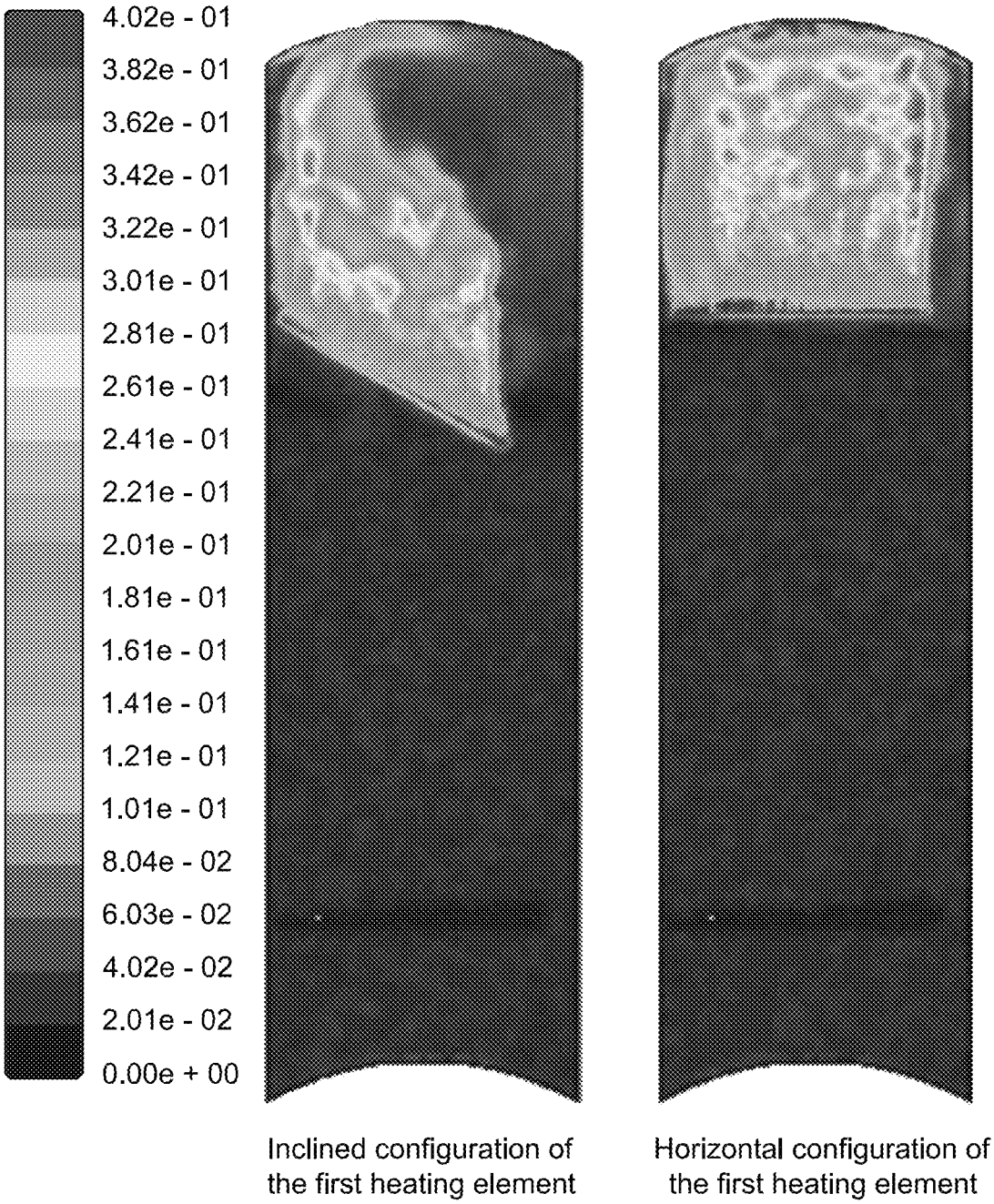
FIG. 4 shows instantaneous velocity contours for the inclined configuration of the first heating element and the horizontal configuration of the first heating element.

In the inclined configuration, where the first heating element 120 is inclined with respect to the base 126 of the tank 102, a large volume of water, particularly the water in the first portion 122 of the tank 102, is influenced by the heat transfer from the first heating element 120. As described earlier, the volume of the first portion 122 of the tank 102 increases with the increase in the distance between the first coupling 124 and the top end 116 of the tank 102. As a result, the large volume of the water is heated during a predefined heating process, for example a first-hour rating (FHR) test. Here, it is assumed that water is not drawn from the tank during the predefined heating process. By the virtue of water circulation effect and rise of heated water caused due to natural heat convection within the first portion 122 of the tank 102, heated water flows (see velocity contours in FIG. 4) towards the inner surface 118 of the tank 102 and towards the first thermostat 128. Therefore, temperature at the first coupling 124 and the first thermostat 128 is higher compared to a remainder volume 'R' (see FIG. 3) of the first portion 122 of the tank 102. In such conditions, the temperature of the water in the first portion 122 of the tank 102 as sensed by the first thermostat 128 may be high, while the temperature of water in the remainder volume 'R' may be comparatively low. However, on an average, the water in the first portion 122 of the tank 102 may be warm enough to be used and may also be considered for determining the FHR.

In the horizontal configuration, where the first heating element 120 is disposed parallel to the base 126 of the tank 102, as can be noticed from FIG. 3, volume of water influenced by the heat transfer from the first heating element 120 is less than that of the inclined configuration. Further, as the first heating element 120 begins to heat the water during the predefined heating process, the heated water flows upwards (as can be noticed in FIG. 4 as well) instead of flowing towards the inner surface 118 of the tank 102 and towards the first thermostat 128, by the virtue of water circulation effect and rise of heated water caused due to the natural heat convection. Therefore, the first thermostat 128 senses a temperature that is comparatively lower than a remainder volume 'R1' of the water being heated by the first heating element 120. Consequently, when the first thermostat 128 reaches a predetermined temperature (for example, a setpoint temperature) at which the heated water may be drawn from the tank 102, the water in the remainder volume 'R1' is comparatively hotter than the water proximal to the first thermostat 128. In other words, a delivery temperature of the water may be too high, which may not be preferred.

Since the volume of water heated by the first heating element 120 in the horizontal configuration is less than the volume of water heated by the first heating element 120 in the inclined configuration, the horizontal configuration is associated with a lower FHR compared to the FHR of the inclined configuration. Therefore, with the inclined configuration of the first heating element 120, the system 100 achieves a higher FHR.

Figure 5:
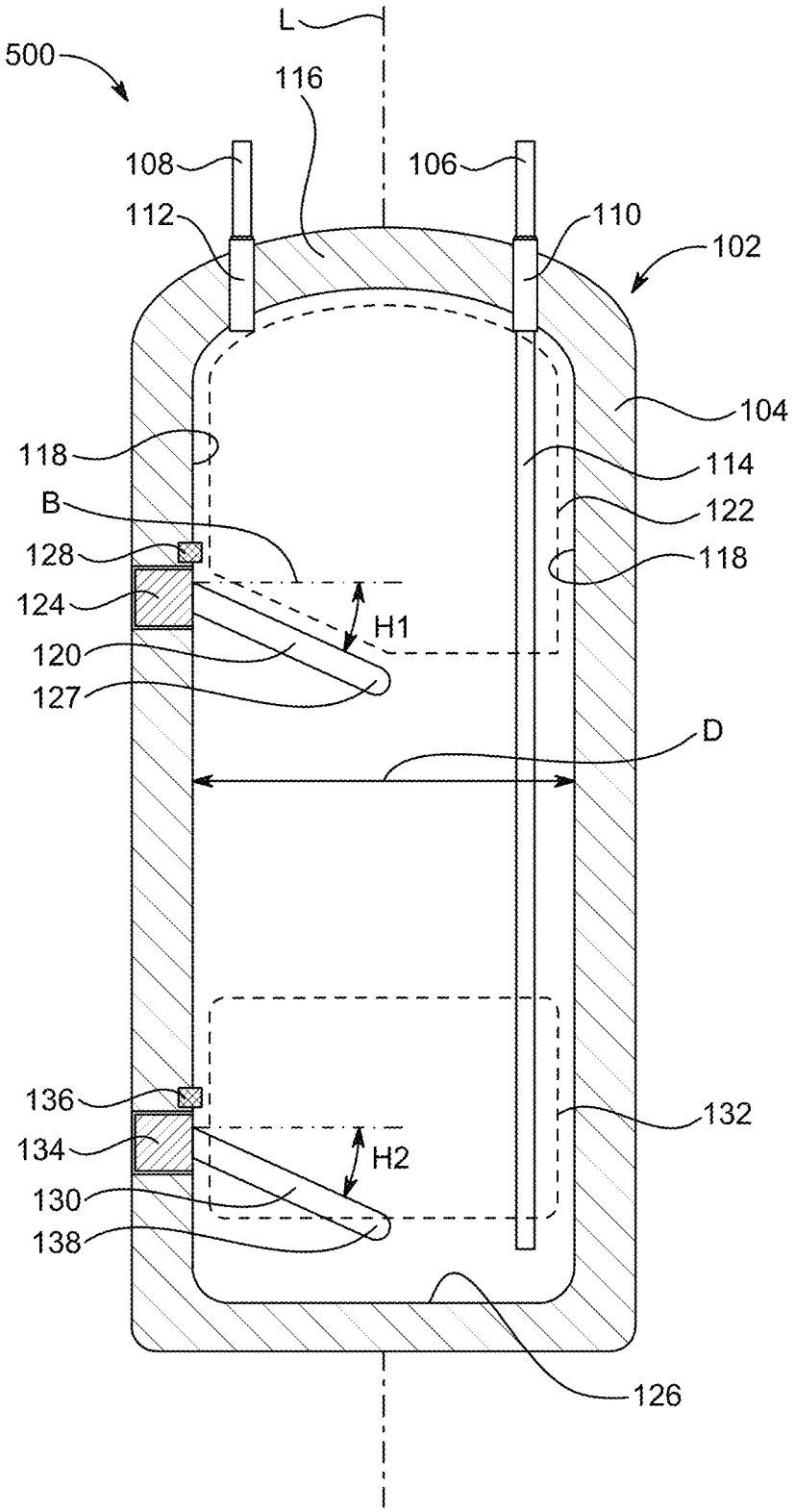
FIG. 5 is a cross-sectional view of the water heating system, according to another embodiment of the present disclosure.

Referring to FIG. 5, a water heating system 500 is illustrated, according to another embodiment of the present disclosure. In addition to the first heating element 120 disposed inclined at the first predefined angle 'H1' as described earlier, the second heating element 130 is disposed inclined at a second predefined angle 'H2' with respect to the base 126 of the tank 102. In an embodiment, the second predefined angle 'H2' is in a range of zero degree to about 45 degrees. In a preferred embodiment, the second predefined angle 'H2' is 25 degrees.

In an embodiment, the second coupling 134 may be configured similar to the first coupling 124, to allow the second heating element 130 to be disposed in an inclined manner. It is ensured that a distal end 138 of the second heating element 130 lies sufficiently above the base 126 of the tank 102 to prevent scaling of the second heating element 130 or any influence of the scaling on the operation of the second heating element 130. Further, with the inclined configuration of the second heating element 130, volume of water influenced by heat transfer from the second heating element 130 is greater compared to a corresponding horizontal configuration (shown in FIG. 1) of the second heating element 130. The manner of heating of the water by the inclined configuration of the second heating element 130 is similar to that of the inclined configuration of the first heating element 120 described with respect to FIG. 3. Therefore, the inclined configuration of the second heating element 130 contributes towards increasing the FHR achieved by the inclined configuration of the first heating element 120.

In an embodiment, for residential water heating systems, an input power supplied to each of the first heating element 120 and the second heating element 130 is in a range of about 1000 W to about 6000 W. However, commercial water heating systems may require a higher input power supply. It will be understood that the FHR may be varied by varying the input power supply to the heating elements, however subjected to a power rating of the heating elements.

Figure 6:
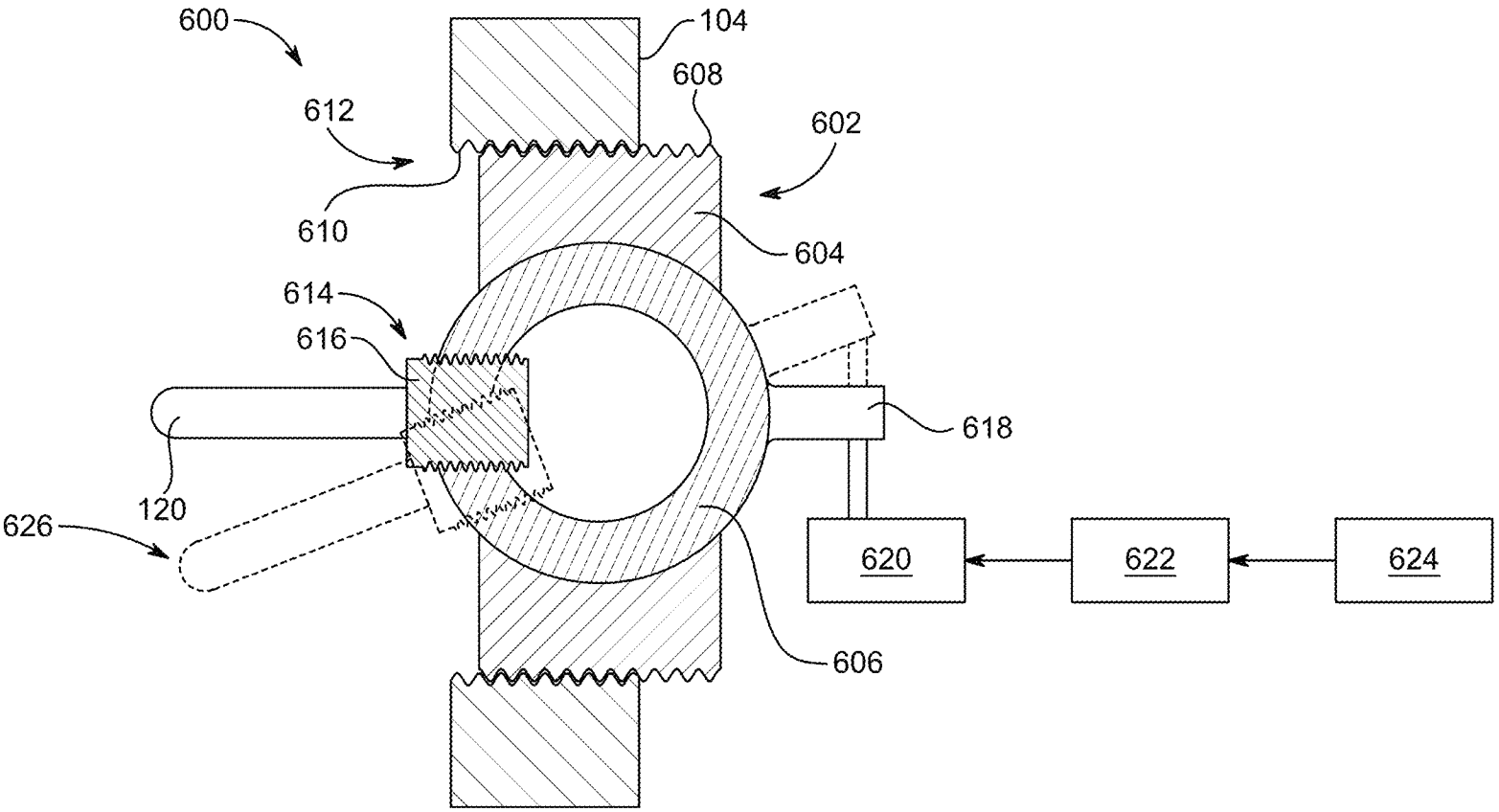
FIG. 6 shows an arrangement for adjusting inclination of the first heating element, according to an embodiment of the present disclosure.

In some embodiments, the inclination of the first heating element 120 and the second heating element 130 may be varied to address a demand for hot water within a short time interval. FIG. 6 shows an arrangement 600 for adjusting inclination of the first heating element 120 with respect to the base 126 of the tank 102. In an embodiment, the first coupling 124 may be replaced with a unit 602 to allow adjusting the inclination of the first heating element 120 based on user input. The unit 602 includes a housing 604 and a rotatable member 606 disposed in the housing 604. An outer surface of the housing 604 defines threads 608 configured to engage with corresponding threads 610 defined at a periphery of an opening 612 formed in the wall 104 of the tank 102. The rotatable member 606 is embodied as a hollow ball-like structure capable of being rotated inside the housing 604 in multiple degrees of freedom. In an example, the housing 604 and the rotatable member 606 may constitute a swivel ball-joint.

In an embodiment, the rotatable member 606 defines an opening 614 to threadably receive a holder 616 and includes a shaft 618 located diagonally opposite to the opening 614 thereof, where the shaft 618 extends from an outer surface of the rotatable member 606. In such arrangement, movement of the shaft 618 causes corresponding rotational movement of the rotatable member 606 in the housing 604. The holder 616 is configured to couple with the first heating element 120. As such, the rotational movement of the rotatable member 606 causes angular movement of the first heating element 120. Although the first heating element 120 is shown including a single heating arm, it is anticipated that the first heating element 120 may be embodied to include two heating arms, a cup-type heating element, or be replaced with any other electric heating element know to the person skilled in the art.

For the purpose of applying force on the shaft 618, the system 100 includes an actuator 620 coupled to the shaft 618 of the unit 602. The actuator 620 is configured to adjust the inclination of the first heating element 120 with respect to the base 126 of the tank 102 based on the user input. It will be apparent to the person skilled in the art that the actuator 620 may be embodied as an electrical device, a mechanical device, a pneumatic device, a hydraulic device, or as a combination of two or more such devices capable of causing movement of the shaft 618 of the unit 602. In an embodiment, the system 100 may also include a controller 622 coupled to the actuator 620 and configured to operate the actuator 620. The controller 622 may be embodied as a control module that is constituted by a single processing unit or a number of processing units. Further, the control module may be implemented as one or more microprocessors, digital signal processors, central processing units (CPUs), logic circuitries, and/or any device that manipulates signals based on operational instructions. The functions of control module may be provided using dedicated hardware as well as hardware capable of executing software in association with appropriate software.

In an embodiment, a user device 624 may be communicably coupled with the controller 622. In an example, the user device 624 may be a smartphone or any graphic user interface capable of communicating inputs to the controller 622. The user may indicate a demand for hot water in form of the user input that is communicated to the controller 622 from the user device 624. Based on the user input, the controller 622 may be configured to operate the actuator 620 to adjust the inclination of the first heating element 120 in the tank 102 to achieve an inclined position 626 as shown in FIG. 6. As can be inferred from the earlier description, volume of the water influenced by the heat transfer from the first heating element 120 increases with the increase in inclination of the first heating element 120. However, it will be appreciated that such influence on the volume of the water may be applicable only to a range of the first predefined angle 'H1' mentioned with respect to FIG. 1. Although not specifically stated, it should be understood that the change in inclination of the first heating element 120 is performed in a direction towards the base 126 of the tank 102 and not in a direction towards the top end 116 of the tank 102.

In another embodiment, the system 100 may include another unit (not shown) and another actuator (not shown) configured to adjust the inclination of the second heating element 130 based on the user input.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A water heating system comprising:

a tank having a wall;

a water inlet defined through the wall and configured to allow ingress of water into the tank;

a water outlet defined through the wall and configured to allow egress of water from the tank;

a first heating element disposed in a first portion of the tank, wherein the first heating element has a substantially elongate shape and is inclined with respect to a base of the tank; and an actuator coupled to the first heating element, wherein the actuator is configured to adjust the first heating element, based on a user input, between a first inclination angle with respect to the base of the tank and a second inclination angle with respect to the base of the tank.

2. The water heating system of claim 1 further comprising a first coupling disposed through the wall of the tank, the first coupling configured to removably receive the first heating element.

3. The water heating system of claim 2, wherein the first coupling defines an aperture, and wherein an axis of the aperture is configured to adjust between the first inclination angle and the second inclination angle.

4. The water heating system of claim 1 further comprising a first thermostat configured to sense temperature of water in the first portion of the tank.

5. The water heating system of claim 1, wherein at least one of the first inclination angle and the second inclination angle is in a range of about 15 degrees to about 45 degrees.

6. The water heating system of claim 5, wherein at least one of the first inclination angle and the second inclination angle is in a range of about 25 degrees to about 35 degrees.

7. The water heating system of claim 6, wherein at least one of the first inclination angle and the second inclination angle is approximately 30 degrees.

8. The water heating system of claim 1 further comprising a second heating element disposed in a second portion of the tank, the second portion being proximate the base of the tank.

9. The water heating system of claim 8, wherein the second heating element is inclined at a third inclination angle with respect to the base of the tank.

10. The water heating system of claim 9, wherein the third inclination angle is in a range of zero degrees to about 45 degrees.

11. The water heating system of claim 8 further comprising a second coupling disposed through the wall of the tank, the second coupling configured to removably receive the second heating element.

12. The water heating system of claim 8 further comprising a second thermostat configured to sense temperature of water in the second portion of the tank.

13. A water heating system comprising:

a tank having a wall;

a water inlet defined through the wall and configured to allow ingress of water into the tank;

a water outlet defined through the wall and configured to allow egress of water from the tank;

a first heating element disposed in a first portion of the tank and configured to heat water present in at least the first portion of the tank, wherein the first heating element has a substantially elongate shape and is inclined with respect to a base of the tank;

an actuator configured to adjust the first heating element between a first inclination angle and a second inclination angle, each of the first and second inclination angles being measured with respect to the base of the tank; and a second heating element disposed in a second portion of the tank, the second portion being proximate the base of the tank, wherein the second heating element is inclined at a third inclination angle with respect to the base of the tank and configured to heat the water present in at least the second portion of the tank, wherein the first and second inclination angles are in a range of about 15 degrees to about 45 degrees and the third inclination angle is in a range of about zero degrees to about 45 degrees.

14. A water heating system comprising:

a tank having a wall;

a water inlet defined through the wall and configured to allow ingress of water into the tank;

a water outlet defined through the wall and configured to allow egress of water from the tank;

a heating element having a substantially elongate shape and configured to extend into the tank; and an actuator configured to move the heating element between a first angle and a second angle that is different from the first angle, the first and second angles being measured relative a base of the tank.

15. The water heating system of claim 14 further comprising a first coupling disposed within the wall of the tank, the first coupling configured to removably receive the heating element.

16. The water heating system of claim 15, wherein the first coupling comprises an aperture extending therethrough, the aperture having an axis configured to adjust between the first angle and the second angle.

* * * * *